US005419502A

United States Patent [19]

Morey

[11] Patent Number: 5,419,502

[45] Date of Patent: May 30, 1995

[54] TUB GRINDER SYSTEMS AND METHODS FOR COMMINUTING WASTE WOOD

[75] Inventor: Norval K. Morey, Weidman, Mich.

[73] Assignee: Wood Technology, Inc., Winn, Mich.

[21] Appl. No.: 48,792

[22] Filed: Apr. 14, 1993

[51] Int. Cl.[6] ..... B02C 13/06; B02C 13/28

[52] U.S. Cl. ..... 241/101.7; 241/197

[58] Field of Search ..... 241/101.7, 73, 89.5, 241/186.35, 189.1, 197, 191, 28, 298, 300, 192, 195; 125/15; 51/206 R, 206 S, 319, 320

[56] References Cited

U.S. PATENT DOCUMENTS

| | | | |
|---|---|---|---|
| 325,849 | 9/1885 | McKendrick . | |
| 649,985 | 5/1900 | Hall . | |
| 1,675,658 | 7/1928 | Mursch . | |
| 2,133,212 | 10/1938 | Schutte et al. . | |
| 2,196,722 | 4/1940 | Clement . | |
| 2,208,892 | 7/1940 | Bukacek . | |
| 2,488,799 | 11/1949 | Bonnafoux . | |
| 2,530,313 | 11/1950 | Parten . | |
| 2,899,992 | 8/1959 | Key . | |
| 3,553,905 | 1/1971 | Lemelson | 123/15 X |
| 3,612,420 | 10/1971 | Hull . | |
| 3,856,217 | 12/1974 | Brewer . | |
| 3,856,218 | 12/1974 | Harmon et al. | 241/36 X |
| 3,981,455 | 9/1976 | Kaczmarek | 241/32 |
| 4,147,198 | 4/1979 | Kivimaa | 144/235 |
| 4,164,329 | 8/1979 | Higby | 241/294 |
| 4,504,019 | 3/1985 | Newell et al. | 241/73 |
| 4,687,144 | 8/1987 | Irwin et al. | 241/49 |
| 4,697,626 | 10/1987 | Arasmith | 144/373 |
| 4,768,126 | 7/1987 | Prentice et al. | 241/34 |
| 4,795,103 | 1/1989 | Lech | 241/77 |
| 4,915,310 | 4/1990 | Stolk | 241/197 |
| 4,997,135 | 3/1991 | Zehr | 241/101.7 |
| 5,141,167 | 8/1992 | Stelk | 241/197 X |

*Primary Examiner*—Douglas D. Watts

*Attorney, Agent, or Firm*—Learman & McCulloch

[57] ABSTRACT

A comminuting machine for waste wood and other waste comminutable material has a vehicle frame and a conveyor in the form of a tub or bed for receiving material to be comminuted. A comminuting assembly has a shaft with a series of rotors with flat radially extending side walls fixed in an angularly offset continuous helical array from one end to the other on the shaft. Comminuting members presenting blunt material shattering beads are releasably secured on the arm mounting surfaces.

27 Claims, 7 Drawing Sheets

TG
58
62
63
23
26
46
46a
47
48
11
12
20
29
60
25
27
28
24
28
55
49
18
10
DE
L
15
13
14

FIG-9
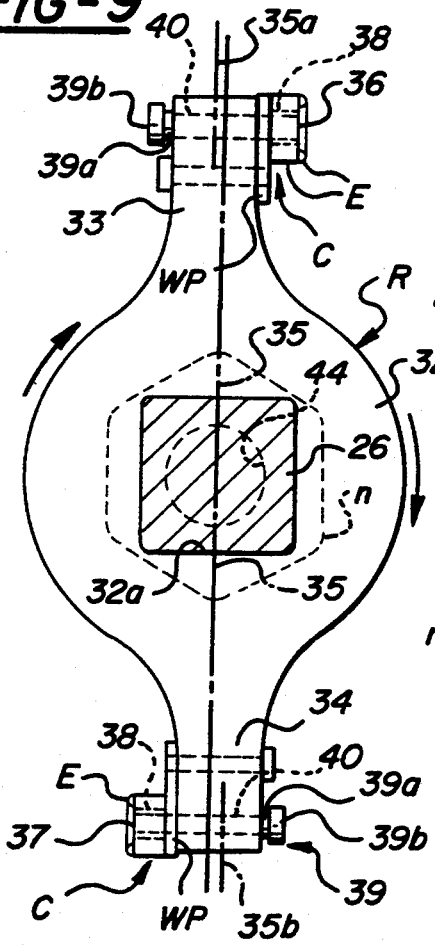
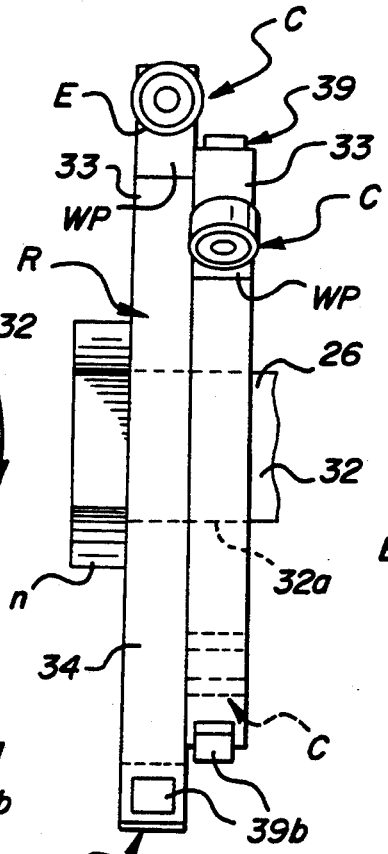
FIG-8
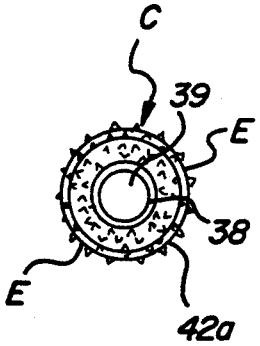
FIG-10
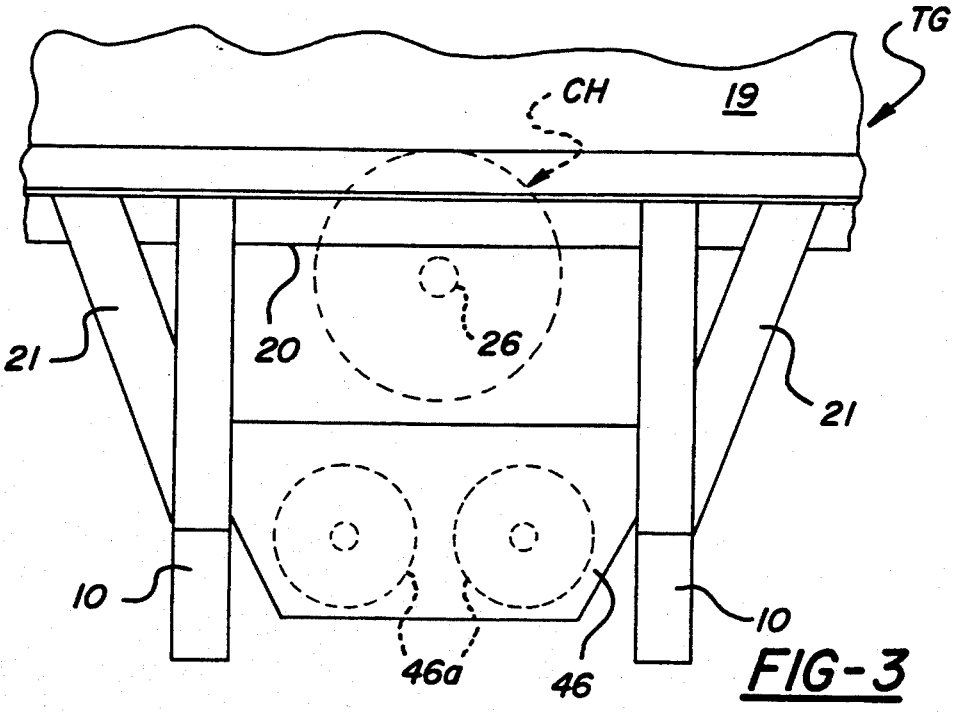
FIG-3

TG
49a
50
51
53
52
57
19
60
59
58
56
62
54
49
55
63
58

43
38
43
42
C 42
38
WP
36
R
39b
E
X
GA
39
Y
41
40
X
C
42a
44
43
36a
45a
39a
45b
45

TG
66
19
64
65
55

38
39
X
WP
Y

38
X
Y
WP

FIG-6
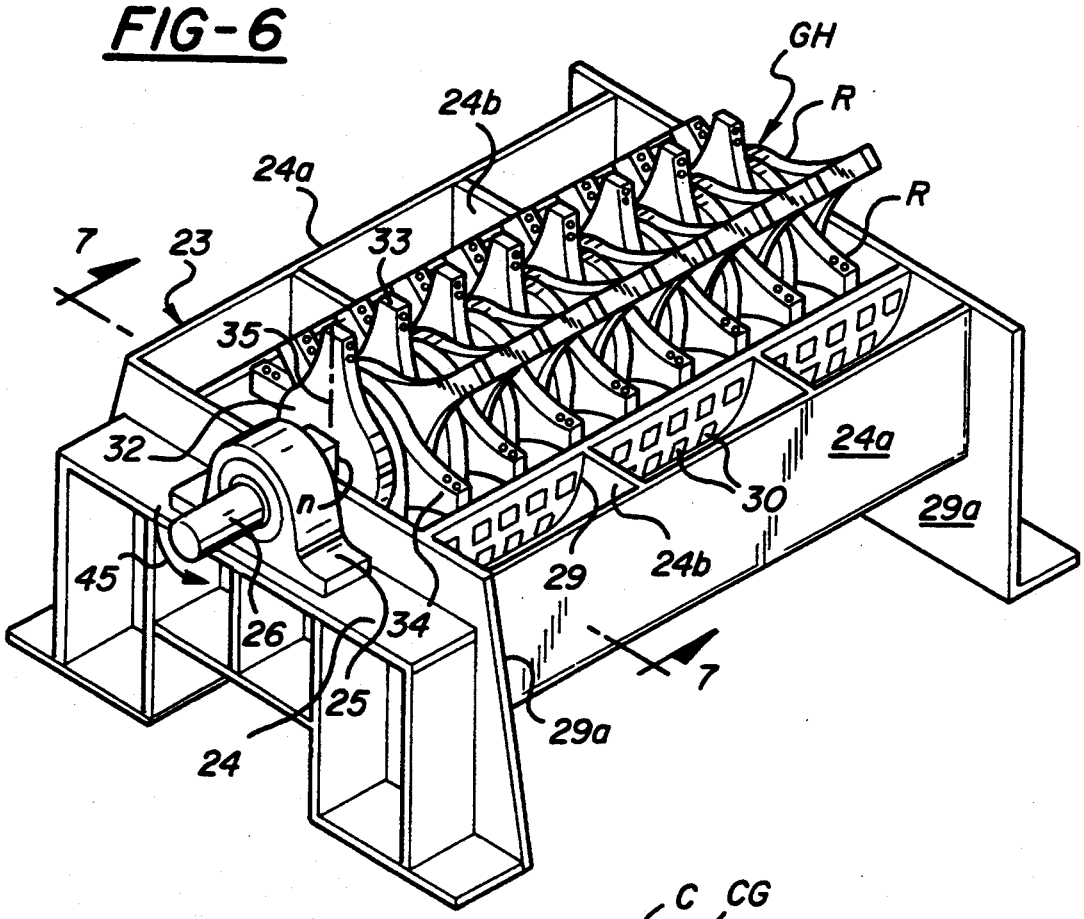
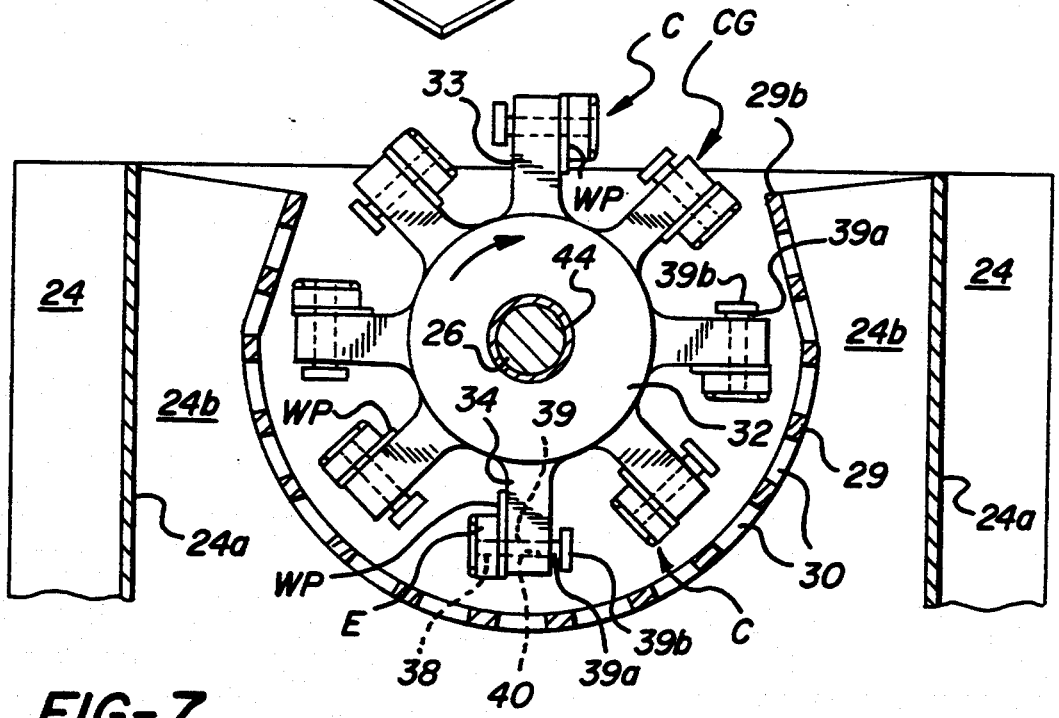
FIG-7

TUB GRINDER SYSTEMS AND METHODS FOR COMMINUTING WASTE WOOD

BACKGROUND OF THE INVENTION

This invention relates to recycling systems and methods including apparatus which is generically described as a tub grinder. Such machines, which may also be referred to as waste wood recyclers, are used today to convert stumps, brush, pallets, ties, large timbers, demolition debris, old dead trees, old lumber piles and the like to particulates which are useful, for example, as mulch, ground cover, material which can be used as a bulking agent for composting sewage sludge, and as fuel for high temperature incineration systems which generate processed steam. Such systems are a cost effective alternative to the land filling of the bulky material, which is expensive and uses up huge tracts of land adjacent municipalities which are better used for other purposes. Typically, tub grinders have utilized hammermills for the purpose of grinding the material to a particular size to provide material suitable for composting, erosion control, boiler fuel and landscaping ground cover. Such hammermills have been relatively short-lived and expensive to maintain. Typically, they have been used to process small stumps and material up to twelve inches in diameter, but have not been, to my knowledge, used for much heavier wood waste.

SUMMARY OF THE INVENTION

The present system incorporates a comminuting assembly having a series of side-by-side comminuting rotors fixed in angularly offset helical array on a shaft extending crosswise to the path in which the material is moved. Each one piece rotor comprises a hub part fixed on the shaft and has mounting arms extending from the hub part. The arms have generally radial mounting surfaces on their outer terminal ends to receive replaceable carbide comminuters of a novel character.

One of the prime objects of the present invention is to provide a more effective and efficient system and method for disposing of the wood waste material indicated, which enables tub grinders, for example, to handle larger and bulkier material with less horsepower, and to reduce it to relatively fine particulates at greatly increased production rates.

Still a further object of the invention is to design a system of the character described in which the rotors for a tub grinder are provided on the shaft in a helical array which tends to direct the wood being progressively reduced toward the rotating tub side wall.

Another object of the invention is to provide a rugged system of the character described wherein the rotors can be individually mounted on the rotor shaft without the need for keyways which would structurally weaken the relatively axially reduced width rotors.

Still a further object of the invention is to provide a system of the character described which releasably employs throw-away comminuters at the ends of the rotors to aggressively reduce the wood material, rather than slice it.

A further object of the invention is to design a grinder system which is durable and experiences little down-time, except that which is required for adjusting or changing the readily released comminuters.

A further object of the invention still is to provide a grinder system which is far less expensive to operate, and which can be manufactured and marketed at a more economic price.

Another object of the invention is to provide a grinder machine of the type described which will comminute waste wood material in one pass of the material past the reducing assembly which formerly required several passes.

Other objects and advantages of the invention will become apparent with reference to the accompanying drawings and the accompanying descriptive matter.

THE DRAWINGS

In the drawings, FIG. 1 is a somewhat schematic side elevational view of a typical tub grinder;

FIG. 3 is a somewhat schematic fragmentary end elevational view illustrating the wood fragment recycling bin;

FIG. 6 is a fragmentary perspective elevational view of the comminuter assembly only, with the comminuter elements being omitted in the interests of clarity;

FIG. 7 is a transverse sectional elevational view thereof taken on the line 7—7 of FIG. 6;

FIG. 8 is an enlarged fragmentary side elevational view of one of the comminuting arms on the assembly;

FIG. 9 is an enlarged end elevational view of one of the comminuting head rotor members only;

FIG. 10 is an enlarged head on view of one of the comminuter elements;

DESCRIPTION OF THE PREFERRED EMBODIMENT

Figure 1:
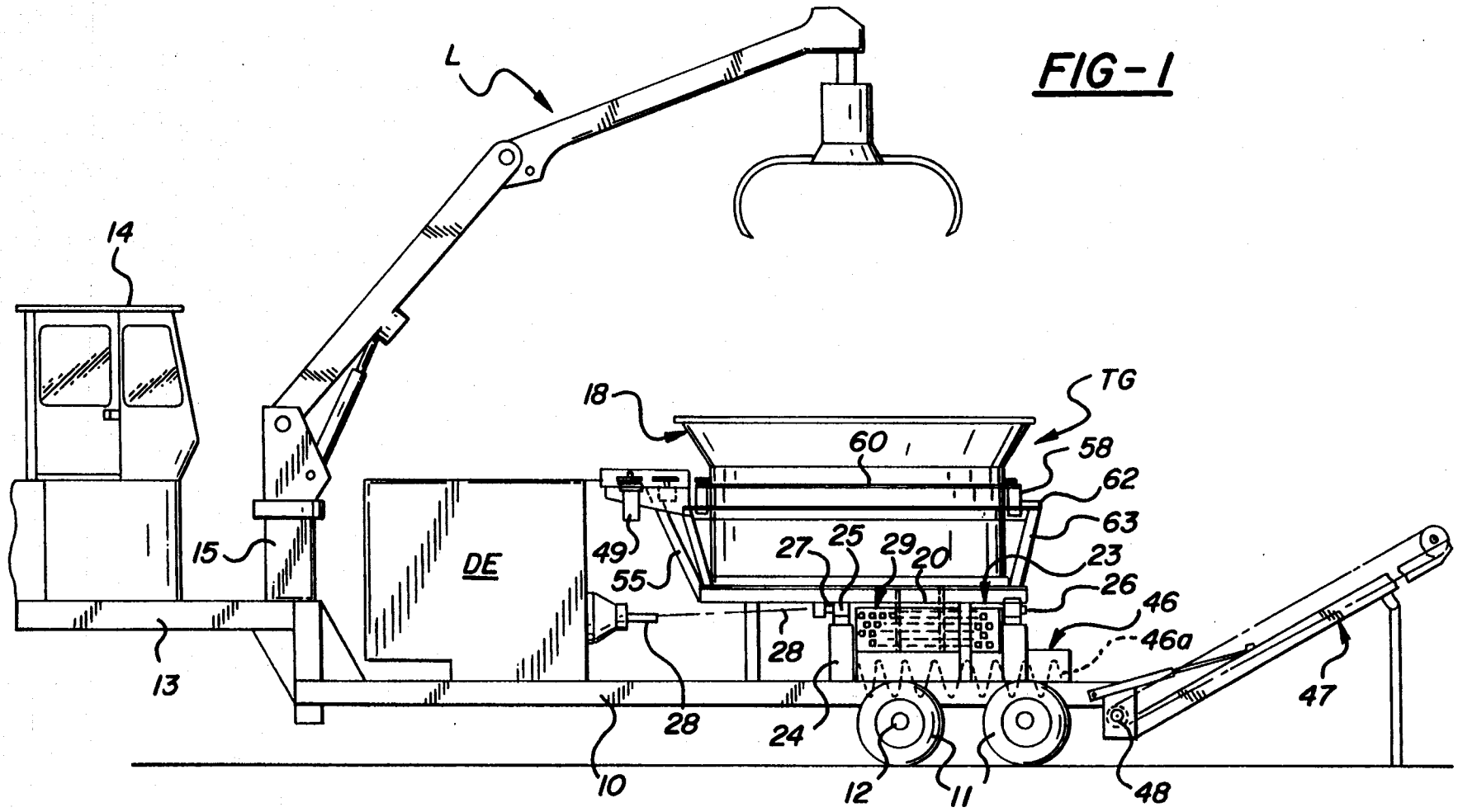
Figure 2:
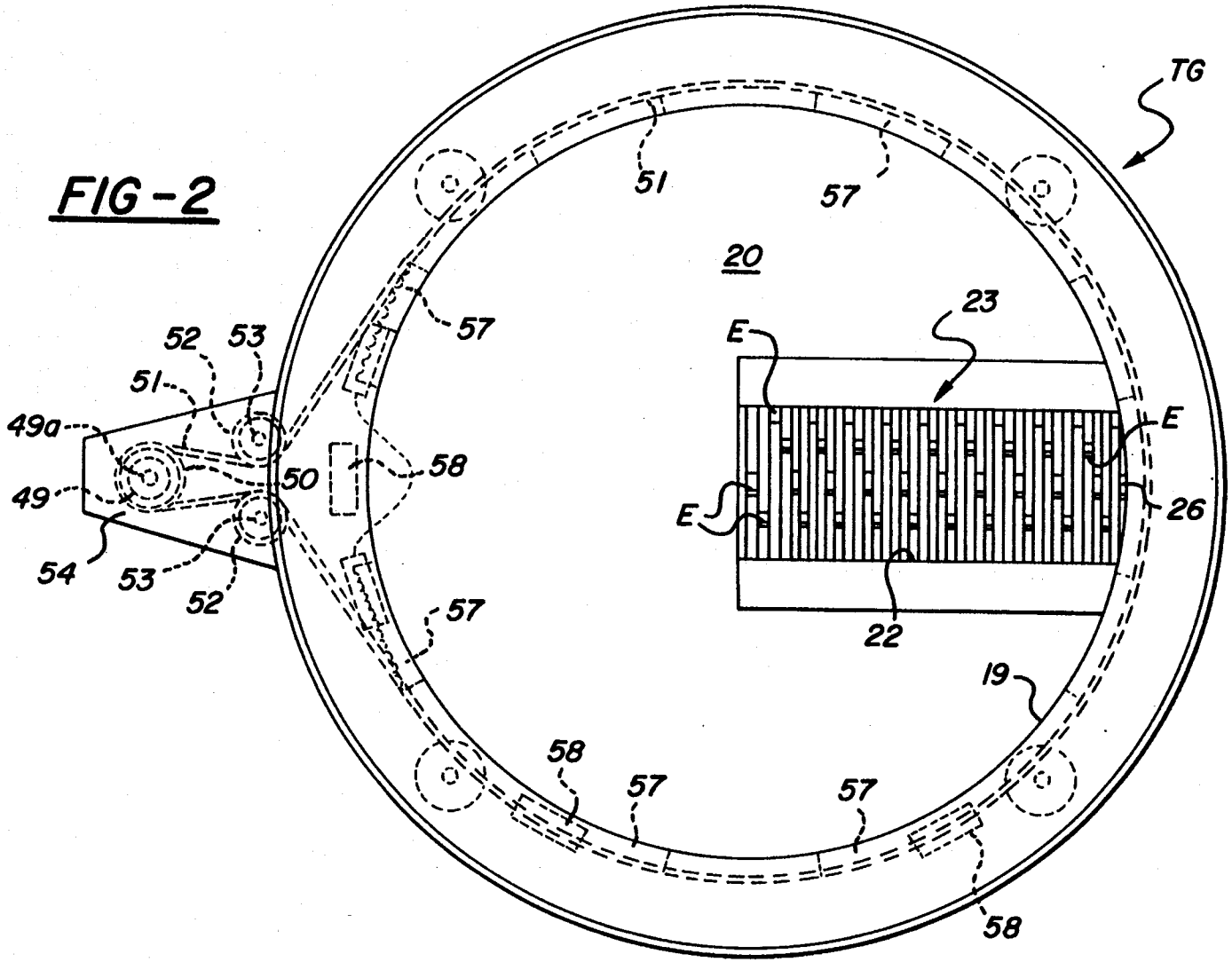
FIG. 2 is a somewhat schematic fragmentary, top plan view thereof on an enlarged scale.

Referring now more particularly to FIGS. 1 and 2, the tub grinder, generally indicated at TG, includes a mobile chassis frame 10, mounted at one end on wheels 11 which have dead axles 12 supporting the frame 10 via a suitable suspension system (not shown). The front end of the frame 10 includes a tow bar 13 which can be releasably connected to any suitable tractor vehicle or prime mover for moving the tub grinder to and from the grinding site over a road system. An operator's cab 14 may be mounted on the portion 13 of the frame 10, as is an upright journal 15 for rotatably mounting a typical loader, generally designated L. The loader L, in the usual manner, includes an articulated boom, generally designated 16, which has openable and closeable pivotal claws 17 at its terminal end. The loader L is conventional and will not be further described, except to say that it is swingable from side to side and movable from a ground location to the position in which is shown above the material-receiving conveyor tub generally designated 18, supported on the opposite end of the frame 10. The loader is maneuverable by an operator sitting in cab 14 to pick up waste wood material and release it by opening claws 17 when the loader moves the material to a position above the tub 18.

The tub 18 is annular in configuration and includes a rotatably mounted side wall 19, and a bottom wall 20 which is fixed to the frame 10 by means of support legs 21. It is to be understood that the tub wall 19 may be pivotally supported at one side of the frame so that it may be tilted laterally away from the stationary floor 20. As FIG. 2 particularly indicates, the floor 20 includes a generally radially extending opening or slot 22, and, below the slot 22, is a comminuting head assembly, generally designated 23, which is fixed on the frame-10.

As FIGS. 6 and 7 particularly indicate, the assembly 23 includes end support framing 24, mounting bearings 25 at each end for journaling the comminuting rotor shaft 26. The shaft 26 is coupled as at 27 to a shaft 28 driven by the diesel engine DE which drives the otherwise fixed shaft 26 in rotation.

As FIGS. 6, 8 and 9 particularly indicate the shaft 26 is substantially square in cross-section intermediate its ends. It will be noted that the end members 24 are joined by side plates **24*a* which have braces 24*b* for supporting a curvilinear screen 29 having openings 30 of a predetermined size and shape. The screen 29 surrounds the lower half of the comminuting head, generally designated CH, and is suspended within the open bottom frame formed by members 24, 24*a* and 24*b* fixed on end sections 29*a***.

As FIGS. 8 and 9 particularly indicate, the comminuting head CH includes a helical array of side by side rotors R which, as shown in FIG. 6 particularly, include integral hub portions 32 and substantially radially extending, substantially in-line arms 33 and 34 which extend on centerlines **35*a* and 35*b* parallel to but offset slightly from the hub portion centerlines 35. The rotors R have complementary square-shaped, shaft-receiving openings 32*a* to fix them against rotation, and may also be mounted on the shaft 26 at 90° intervals, instead of the 45° intervals illustrated in FIG. 6. They may be axially-spaced from one another by circular spacer discs on the shaft 26, or may be in facial contact as shown in FIG. 6. The rotors, or rotors and spacers, may be fixed in axial abutment by nuts n threaded on cylindrical threaded portions of the shaft inward of bearings 25. Comminuting element mounting, generally radially extending, parallel surfaces 36 and 37 are provided on opposite edges of the arms 33 and 34 respectively, at 180° intervals, to mount identical wear plates, generally designated WP, which carry releasable, comminuting elements, generally designated C, with circular, peripheral, axially protrudent, blunt bead edges E. It will be noted that the mount surfaces 36 and 37 are parallel to the centerlines 35, 35*a*, and 35*b*, as are wear plate mount surfaces 36*a***.

The circular elements C are provided with centered pairs of threaded bores 38, for receiving bolts 39 which extend through bored openings 40 in the arms and bored openings 41 in the wear plates WP, to releasably secure the elements C in position. Washers **39*a* may be used adjacent the bolt heads 39*b***.

Figure 11A:
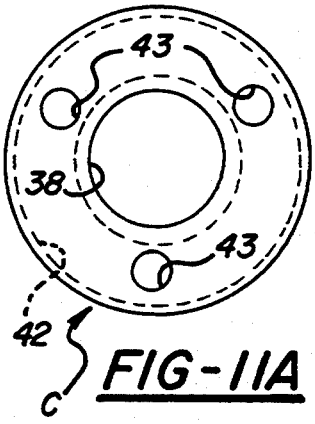
FIG. 11A is an enlarged rear elevational view of the comminuter element illustrated in FIG. 10.
Figure 11:
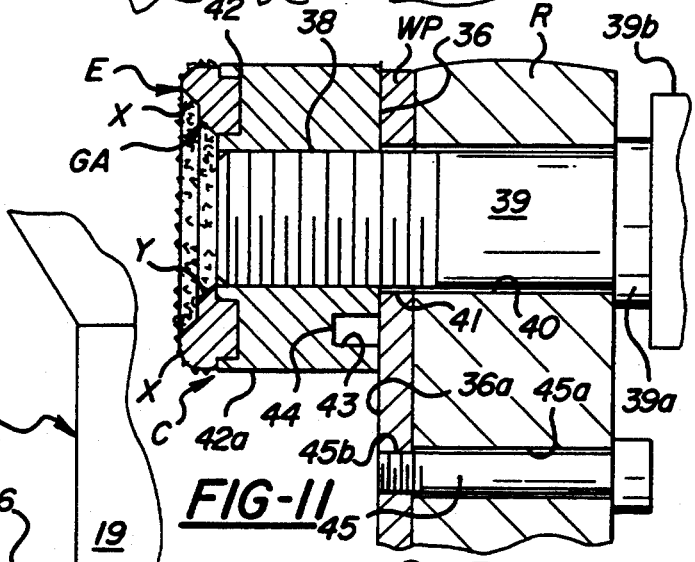
FIG. 11 is an enlarged fragmentary, sectional, end elevational view more particularly illustrating the construction of the comminuter element and the wear plate.

The rotors R may be formed of a mild steel which permits them to be torch cut from steel plate material, whereas the wear plates WP are fabricated from a tougher, more wear resistant high carbon, alloy steel having a brinell hardness on the order of forty or higher. The members C (see FIG. 11) include cup-like, high carbon alloy steel elements **42*a*, of the same or greater hardness than wear plates WP, having circular recesses 42 for the reception of a tungston carbide grit agglomerate generally designated GA. The agglomerate GA is formed by melting a steel welding rod and then incorporating a tungston carbide grit in the molten mass and permitting the mass to harden. In so doing, the mass fixes or bonds to the cups 42*a* and the grit, which is heavily concentrated on the outer surface when sprinkled into the molten mass, is fixed in the hardened mass. The mass peripheral bead edges E of arcuate cross section are generally blunt edges, as distinguished from cutting or slicing edges, and project both axially and radially beyond the cup side walls 42*a*. The grit mass includes edges of carbide grit E, which are not melted in the fabricating process, projecting from a melted hard steel matrix y to provide a very hard, very rough abrasive gripping surface, resembling the rough surface of lava, which is substantially harder and more wear resistant than the wear plates WP. The wear plates WP function to protect the rotor arms if the rough surfaced bead edges E are damaged by unusually hard foreign objects in the material being comminuted, as well as to interact with the cup-like elements to firmly fix them against rotation. As shown in FIG. 11, each element C is provided with a series of equally circumferentially spaced base openings 43, i.e. four, for selectively receiving pin 44 which projects from the inner end of each wear plate WP. Thus, each element C may be readily turned 90° to present a fresh edge portion, when edge E wear so dictates, by backing the bolt 39 off slightly, and then securing it again in position after turning the element C to position the pin 44 in a different opening 43. When edge E is substantially worn away, the bolt 39 may be removed so the element C can be replaced. Bolts 45, which extend through openings 45*a* in the rotors R, thread into threaded openings 45*b*** in the wear plates WP to fix them in position on the rotors R.

The helical array of rotors R is such that the waste wood material being cut near the inner end of opening 22 tends to be moved radially outwardly toward rotating wall 19. The upper edge **29*b* of screen 29 functions as an anvil for rotation of the rotors R in the direction indicated in FIG. 7, which is counter to the direction in which the wall 19 moves the material. The wall 19 thus rotates in a counter direction to the direction of rotation of shaft 26**.

Provided beneath the screen 29 is a bin, generally designated 46, within which are screw conveyors **46*a* operating to move the particulate material received through the relatively small openings 30 in screen 29 to a discharge conveyor, generally designated 47. The conveyor 47 is generally a foldable conveyor which can be carried by the tub grinder when the tub grinder is being transported. The conveyor 47 can be pivotally secured to the chassis 10 as at 48**.

Figure 4:
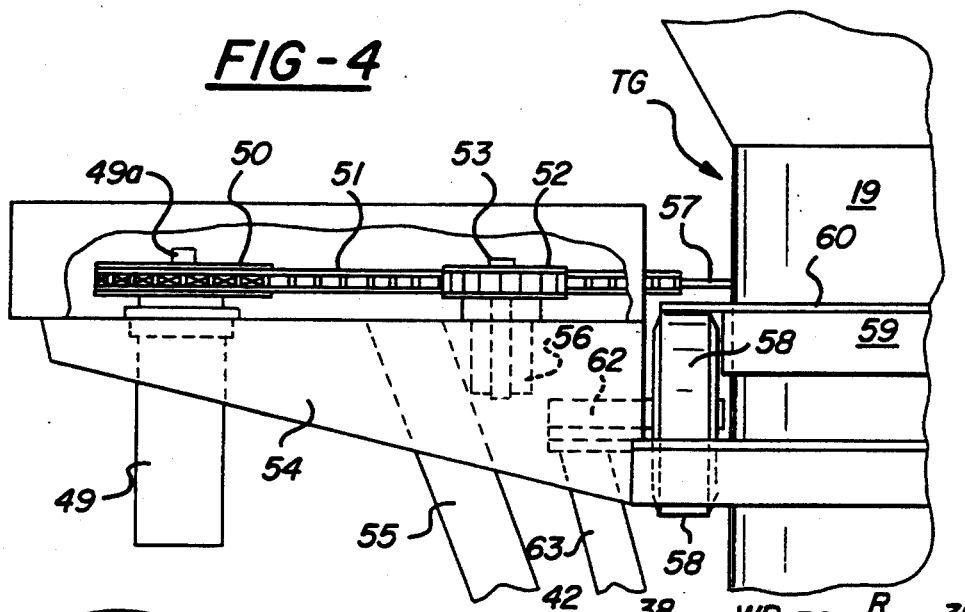
FIG. 4 is an enlarged fragmentary side elevational view illustrating the tub drive mechanism.
Figure 5:
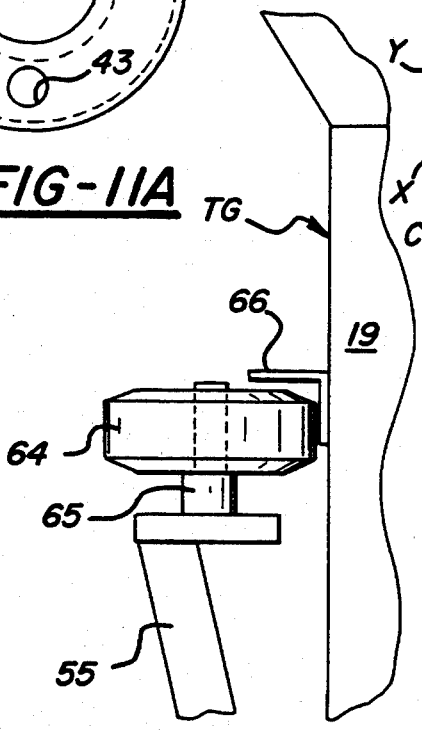
FIG. 5 is an enlarged fragmentary, elevational view illustrating tub guide mechanism.
Figure 12:
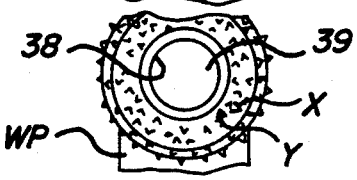
FIG. 12 is a fragmentary view similar to FIG. 10 showing typical wear after prolonged usage.
Figure 13:
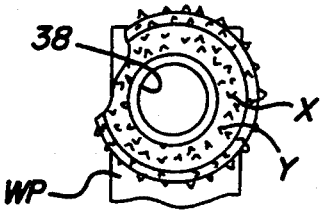
FIG. 13 is a similar view showing the comminuter element adjusted angularly to a fresh position on the wear plate.

It is to be understood that the rotating tub side wall 19 may be suitably driven by a rotary hydraulic motor 49 which may be driven by a pump driven by diesel engine DE, or could be mechanically coupled to engine D.E. The output shaft **49*a* of motor 49 mounts a sprocket 50 which, via a chain 51, revolves a pair of idler sprockets 52 on idler shafts 53. A bracket 54 connected to the floor 20 by supports 55, supports motor 49 and the bearings 56 for journaling shafts 53. As FIG. 2 shows, the chain 51 drives side wall 19, which has a series of toothed arcuate bars 57 fixed around its circumference and engaged with the chain. The side wall 19 is supported for rotation by wheels 58 (FIG. 4) received in the annular trackway 59 formed by wall flange 60. Dead axles 62, supported by legs 63 from the floor 20, journal the wheels 58. For tub guiding purposes, wheels 64 (FIG. 5) rotatable on dead axles 65, can be supported by the supports 55 in engagement with an annular track 66 fixed to tub side wall 19**.

THE OPERATION

In operation, the loader L loads the waste wood into the tub TG and the rotating wall 19 moves it circumferentially along stationary floor 20 to the opening 22 and the comminuter head assembly 23. It should be understood that the rotor arms R protrude up through the floor 22 to a height of 5 inches or more when rotated to an upright position. With the shaft 26 rotating aggressively in a direction counter to the direction in which the wall 19 moves the material to be comminuted, successive elements C on the successive rotor arms 32 shatter and reduce the material. Because the material GA is extremely rough surfaced, it tends to grip and pull the material as it tears it away. All of the waste wood material available is contacted, and the particulates pulled off will pass through the openings 30 in the screen 29. Any waste material which is broken off, and is of too large a size to pass through openings 30, will be carried along by the wall 19 and eventually returned to the cutter head assembly CA. Each of the rotors R is for all practical purposes dynamically balanced, as is the entire cutter head assembly with the elements C on the adjacent rotor arms R arranged at successive 45° or 90° intervals. Sidewisely adjacent rotor arms contact the material before the initial rotor arm again contacts the material and with successive helical arrays, the material is directed radially outwardly. When the edges E become worn or chipped, it is a simple matter to shift to another circumferentially displaced section of the edge E by rotating the position of the element C in the manner discussed, without incurring appreciable down time.

ANOTHER EMBODIMENT

Figure 14:
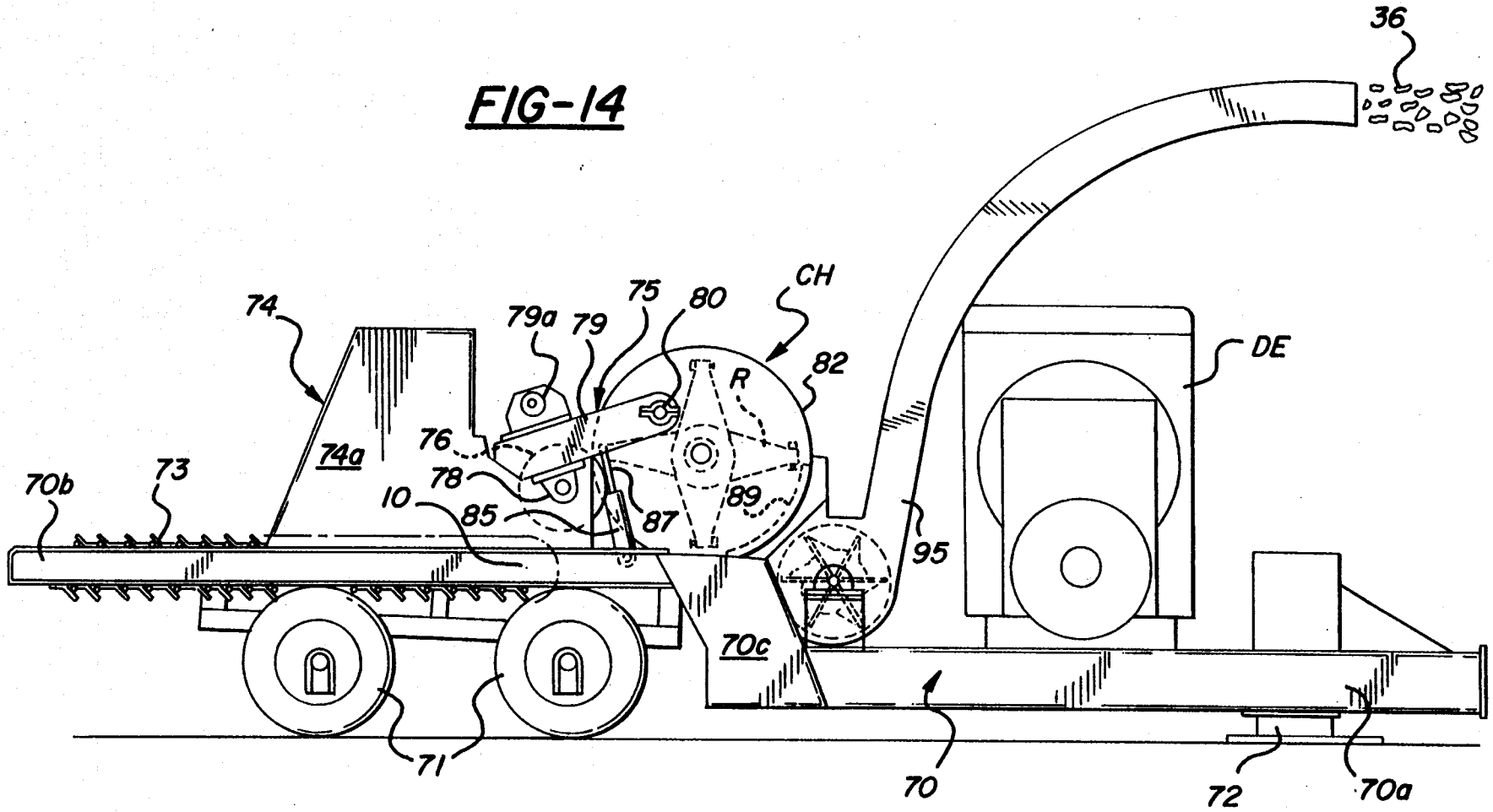
FIG. 14 is a schematic, side elevational view of another embodiment.
Figure 15:
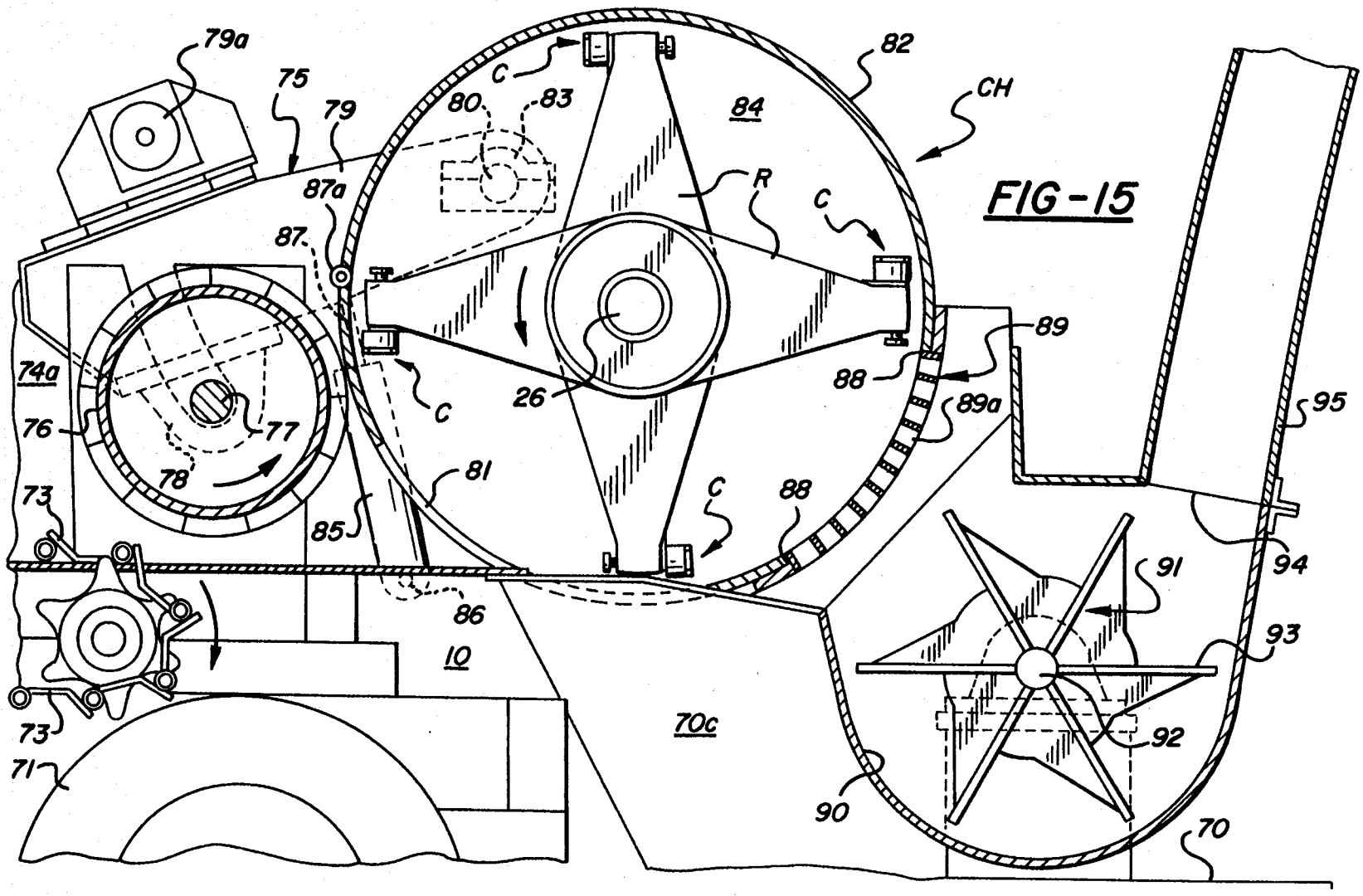
FIG. 15 is a schematic, fragmentary, enlarged, sectional, side elevational view thereof.

In FIGS. 14 and 15, an alternative machine, in which the comminuter assembly, generally designated CH, may be mounted, is shown as mounted on a trailer frame 70 having a tongue portion **70*a* which functions as a tow bar when the machine is to be moved. In FIG. 14, the frame 70 is shown as supported on wheels 71 at its rear end and on vertically adjustable support blocks 72 at its front end. A diesel engine DE for driving the various operating elements to be described through chain and sprocket mechanisms, or by way of a hydraulic pump which powers rotary hydraulic motors, is shown as supported on the front portion 70*a* of the frame 70**. It will be observed that, for the purposes of convenience of description, like parts in this second embodiment are identified by the same numerals used for the same parts already described in the foregoing description of the first embodiment of the invention.

Frame 70 includes a raised rear portion **70*b*, connected with the front portion 70*a* by a transition section 70*c*. Supported on the rear section 70*b*, is an endless caterpillar chain 73** for advancing refuse and material to be chopped, such as stumps and wood timbers from buildings which have been demolished, to the comminuting assembly CH. It is to be understood that the comminuting assembly CH is the same assembly described previously, with the successive rotor arms R, however, arranged perpendicularly.

Mounted on an end wall of the comminuting assembly, or on a separate support, forwardly of an entrance funnel housing 74 having side walls **74*a*, is a pressure arm assembly, generally designated 75, for supporting a crushing and advancing roll 76. The roll, or feed wheel, 76 is shown as mounted on a shaft 77, supported by bearings 78 on a pivot arm frame 79 for vertical swinging movement about a pivots 80. The shaft 77 may be driven by a suitable hydraulic motor 79*a*, via appropriate chain and sprocket mechanism, to rotate the wheel 76 in the direction indicated to feed material from conveyor 73 to an opening 81 provided in the generally circular housing 82 for the comminuting assembly CH. Bearings 83 for supporting the arm assembly 79 may be supported on the frame 10 of the machine laterally outboard of the end walls 84 of housing 82. The air cylinders 85, pivotally connected to the frame 10 at 86, have their piston rods 87 pivotally connected at 87*a* to the arm assembly 79 for raising or lower the arm assembly 79 and drum 76** appropriately and maintaining a material crushing pressure thereon.

An opening 88 is also provided in the opposite wall of the housing 82 and is covered by an arcuate bar screen 89 providing a series of square-shaped screen openings **89*a*, for example, three inches by three inches in size. The screen bars bordering each screen opening function as anvil edges for the edges E provided on the comminuting members C. The fragments of material produced are expelled through the openings 89*a* in the screen 89 to a fan housing 90 for a fan assembly generally designated 91. The assembly 91 includes a shaft 92 on which fan blades 93** are fixed.

As shown, the housing 90 has an upper opening 94 leading to a discharge chute 95 which extends all the way to the front of the trailer frame 10. The material which is comminuted in the comminuting head housing 82 is propelled and sucked through the screen openings **89*a*, and expelled at a rapid speed through the discharge chute 95 as a stream of fragmented materials for disposal. The fan 91 accomplishes a dual function in that it exerts a suction drawing the fragmented materials through the openings 89*a* in the screen 89 as well as operating to physically move them via fan blades 93 and entrain them in the airstream it creates to blow them out discharge chute 95**.

THE OPERATION OF THE SECOND EMBODIMENT

Waste material to be reduced which is deposited on the conveyor 73 passes through the funnel 74 to the feed wheel 76. The feed wheel 76 exerts a crushing pressure while at the same time feeding the material to the opening 81 in the comminuting assembly housing 82. Within housing 82, comminuting rotors R, which rotate in a direction counter to the rotation of feed wheel 76, and counter to the movement of conveyor 73, first shatter the material and pull it in a direction toward screen 89. With approximately a ¾ inch clearance between the comminuting elements C and the screen 89, the steel bars forming screen 89 on the edges of the openings **89*a* function as anvils to fragment the material. The suction created by rapidly revolving fan blades 93 greatly assists in moving the material through openings 89*a* and blows it up discharge chute 95** for transfer to a waiting vehicle or the like.

It is to be understood that the embodiments described are exemplary of various forms of the invention only and that the invention is defined in the appended claims which contemplate various modifications within the spirit and scope of the invention.

I claim:

1. A comminuting machine for waste wood and other waste comminutable material comprising:

a. a vehicle frame;

b. a conveyor thereon;

c. drive mechanism carried on said frame and connected to drive said conveyor;

d. a comminuting assembly, including a generally crosswisely extending shaft journaled for rotation on said frame; there being a series of rotors fixed in an angularly offset continuous helical array on said shaft, each rotor comprising a hub part fixed on said shaft and having a pair of angularly oppositely extending arms of at least the axial thickness of the hub portions extending radially from the hub part to outer terminal ends having radial mounting surfaces on opposite end wall surfaces thereof 180° apart;

e. drive mechanism supported on said frame for driving said shaft and rotors;

f. comminuting members, containing a welded grit-mass of hard material forming a perimetral bead, releasably secured on said radial mounting surfaces to comminute material being moved into said assembly; and g. a screening element supported on said frame at said comminuting assembly for receiving and passing the comminuted material.

2. The machine of claim 1 wherein the hub portions of said rotors have rectilinear openings and said shaft has a mounting section of a complemental rectilinear section on which said rotors are received in side by side relation, with side by side rotors equally angularly displaced from one another.

3. The machine of claim 2 wherein the comminuting members on said side by side rotors are progressively angularly displaced 45° or 90° from one another from one end of the shaft to the other.

4. The machine of claim 3 in which said beads are generally annular.

5. The machine of claim 4 wherein said grit-mass includes a carbide material.

6. The machine of claim 1 wherein the arms of each rotor are mirror images of one another.

7. The machine of claim 1 wherein a comminuted material receiver is provided below said comminuting assembly on said frame below said screen.

8. The machine of claim 5 wherein said members comprise steel cups having a base core and a side wall spaced radially therefrom to provide an annular pocket in which said grit mass is fixed and from which it projects axially outwardly.

9. The machine of claim 8 in which said bead projects radially beyond said side walls of the cups.

10. The machine of claim 1 wherein a wear plate is interposed between said radial mounting surfaces on the rotors and said comminuting members.

11. The machine of claim 10 wherein said wear plates and rotor arm mounting surfaces have aligned openings for receiving fastener means.

12. The machine of claim 11 wherein said comminuting members have bases with a plurality of circumferentially spaced openings and said wear plate has a projecting lock member selectively received in one of said openings.

13. A comminuting machine for use in milling waste wood and other comminutable material in a grinder system having a frame, a receiver for receiving material to be comminuted and feeding it to said machine mounted on said frame; and drive mechanism carried on said frame adapted to be connected to said comminuting machine, the comminuting machine comprising:

a. a shaft with a series of rotors fixed in angularly offset array on said shaft, said rotors comprising hub portions fixed on said shaft and arms extending radially to outer terminal ends having radial mount surfaces thereon extending crosswisely relative to said shaft;

b. angularly adjustable comminuting members releasably secured on said arm mount surfaces to project therefrom and having blunt edges, formed of a hard material comprising particles of grit embedded in and projecting from a matrix to form a rough-surfaced gripping surface, facing in a direction to collectively comminute material moving into the path of said rotors;

c. wear plates on said arm mount surfaces for receiving said comminuting members; and d. fasteners interactive with said comminuting members for fixing said comminuting members in various positions of relative angular adjustment on said arms.

14. The machine of claim 13 wherein said rotors mount wear plates on said arm mount surfaces for receiving said comminuting members and means is interactive between said wear plates and comminuting members for fixing said members in various positions of relative angular adjustment on said wear plates.

15. The machine of claim 13 wherein said edges are formed by a carbide grit-incorporating bead of generally curvilinear cross-section.

16. The machine of claim 13 wherein said shaft and rotors are mounted in a housing having a screen wall portion; a suction housing incorporating a fan with blades connects to said screen and has an outlet spout; and a motor drive mechanism operates said fan to produce a suction drawing fragmented material through said screen and expelling it via said spout.

17. A method of comminuting waste wood such as stumps and other comminutable waste material in a portable machine having a vehicle frame; a conveyor for receiving material to be comminuted, mounted on the frame and moving it in a feeding path; drive mechanism carried on the frame and connected to drive the conveyor; a comminuting assembly including a generally radially extending shaft extending crosswisely to said path and journaled for rotation on the frame, there being a series of rotors fixed in angularly offset array on the shaft, said rotors comprising hubs fixed on said shaft and arms extending from the hubs to outer terminal ends having mount surfaces thereon; drive mechanism supported on the frame for driving the shaft and rotors in rotation; and comminuting members, presenting blunt outer hard edges to the path of the material fed by the conveyor, secured on the arm terminal ends to project therefrom, the steps of:

a. supplying material to be comminuted to the conveyor;

b. driving the conveyor in a direction to move said material toward the comminuting assembly;

c. fragmenting the material with a first comminuter member edge portion on a first rotor and then fragmenting the material with at least a second comminuter member edge section, on a second adjacent rotor, before fragmenting the material with another comminuter portion edge section on the first rotor; and d. when said edge portions are worn, rotating said members to present unworn edges to the material and fixing the members in said rotated positions.

18. The method of claim 17 wherein said comminuting members are formed of a welded rough surfaced grit-mass forming a bead which grips and pulls the material apart as it shatters it.

19. A method of making a waste wood grinder utilizing a system which has a frame; a conveyor for receiving material to be comminuted, mounted on the frame; and drive mechanism carried on the frame and connected to drive the conveyor to move material in a feeding path; comprising the steps of:

a. mounting a comminuting assembly having a shaft in said path crosswisely thereto, and journaling said shaft for rotation on the frame, there being a series of rotors fixed in angularly offset array on the shaft, said rotors comprising hubs fixed on said shaft and arms extending from the hubs to outer terminal ends having cutter mount surfaces thereon, there also being angularly adjustable comminuting members secured on the arm terminal ends to project therefrom and having blunt edges, formed of discrete carbide grit articles projecting from a weld mass matrix, with edge portions facing the feeding path to shatter and pull apart material being moved into the assembly;

b. installing drive mechanism on the frame for driving the shaft and rotors in a direction of rotation complementary to the feeding path; and, c. when said edge portions become worn, angularly adjusting the positions if said comminuted members to present unworn portions of said edges to the material and fixing the comminuting members in said angularly adjusted positions.

20. The method of claim 18 wherein said edges are formed by melting a steel welding rod and incorporating carbide grit in the outer portion of the melt, and then permitting the melt to cool to weld the grit in the steel matrix formed.

21. A comminuting machine for use in milling waste wood and other comminutable material in a grinder system having a frame, a receiver for receiving material to be comminuted and feeding it to said machine mounted on said frame; and drive mechanism carried on said frame adapted to be connected to said comminuting machine, the comminuting machine comprising:

a. a shaft with a series of rotors fixed in angularly offset array on said shaft, said rotors comprising hubs and arms extending radially to outer terminal ends having radial mount surfaces thereon extending crosswisely relative to said shaft;

b. comminuting members secured on said arm mount surfaces to project therefrom and having blunt perimetral edges, formed of a hard material facing in a direction to collectively comminute material moving into the path of said rotors;

c. wear plates on said arm mount surfaces for receiving said comminuting members; and d. means interactive between said wear plates and comminuting members for fixing said members in various positions of relative angular adjustment on said arms.

22. The machine of claim 21 wherein said mount surfaces and wear plates have aligned openings and fasteners extend therein, and said interactive means comprises a pin on each wear plate and a series of circumferentially spaced openings in said comminuting members for selectively receiving said wear plate pin dependent on the angular adjustment of said comminuting members to provide a radially outer edge which is not so worn as to be ineffective.

23. The machine of claim 21 wherein said mount surfaces and wear plates have aligned openings and fasteners extend therein, and said interactive means comprises a pin on each wear plate and a series of circumferentially spaced openings in said comminuting members for selectively receiving said wear plate pin dependent on the angular adjustment of said comminuting members to provide a radially outer edge which is not so worn as to be ineffective.

24. A comminuting machine for use in milling waste wood and other comminutable material in a grinder system having a frame, a receiver for receiving material to be comminuted and feeding it to said machine mounted on said frame; and drive mechanism carried on said frame adapted to be connected to said comminuting machine, the comminuting machine comprising:

a. a shaft with a series of rotors fixed in angularly offset array on said shaft, said rotors comprising hub portions fixed on said shaft and arms extending radially to outer terminal ends having radial mount surfaces thereon extending crosswisely relative to said shaft;

b. comminuting members secured on said arm mount surfaces to project therefrom and having a blunt perimetral edge, formed of a hard material facing in a direction to collectively comminute material moving into the path of said rotors; and c. said edge being formed by a carbide grit-incorporating bead of generally curvilinear cross-section.

25. A comminuting machine for use in milling waste wood and other comminutable material in a grinder system having a frame, a receiver for receiving material to be comminuted and feeding it to said machine mounted on said frame; and drive mechanism carried on said frame adapted to be connected to said comminuting machine, the comminuting machine comprising:

a shaft with a series of rotors fixed in angularly offset array on said shaft, said rotors comprising hub portions fixed on said shaft and arms extending radially to outer terminal ends having radial mount surfaces thereon extending crosswisely relative to said shaft;

b. comminuting members secured on said arm mount surfaces to project therefrom and having a blunt edge, formed of a hard material facing in a direction to collectively comminute material moving into the path of said rotors;

c. said shaft and rotors being mounted in a housing having a screen wall portion;

d. a suction housing which incorporates a fan with blades, adjacent said screen wall portion, and having an outlet spout; and e. a motor drive mechanism operating said fan to produce a suction drawing fragmented material through said screen and expelling it via said spout.

26. The machine of claim 25 wherein said rotors mount wear plates on said arm mount surfaces for receiving said comminuting members, and mechanism is interactive between said wear plates and comminuting members for fixing said members in various positions of relative angular adjustment on said arms.

27. The machine as defined in claim 26 wherein said hard material comprises particles of hard grit projecting from a matrix.

* * * * *

UNITED STATES PATENT AND TRADEMARK OFFICE

CERTIFICATE OF CORRECTION

PATENT NO. : 5,419,502
DATED : May 30, 1995
INVENTOR(S) : Norval K. Morey

It is certified that error appears in the above-indentified patent and that said Letters Patent is hereby corrected as shown below:

Column 4, line 18, change "E" to -- x --.

Column 9, line 41, change "if" to -- of --.

Column 10, line 14, change "21" to -- 22 --.

Signed and Sealed this

Tenth Day of October, 1995

Bruce Lehman

*Attest:*

BRUCE LEHMAN

*Attesting Officer*

*Commissioner of Patents and Trademarks*